US007025299B2

(12) United States Patent
Badiali et al.

(10) Patent No.: US 7,025,299 B2
(45) Date of Patent: Apr. 11, 2006

(54) DEVICE AND PROCESS FOR DEPOSITING THE RESERVE OF THREAD ON THE QUILLS OF OPEN-END SPINNING MACHINES

(75) Inventors: Roberto Badiali, Pordenone (IT); Vittorio Colussi, Cappella Maggiore (IT); Donato Castellarin, Vio Deflioemi (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 0 days.

(21) Appl. No.: 10/964,086

(22) Filed: Oct. 13, 2004

(65) Prior Publication Data

US 2005/0082414 A1 Apr. 21, 2005

(30) Foreign Application Priority Data

Oct. 16, 2003 (IT) ..... MI2003A2006

(51) Int. Cl.
*B65H 65/00* (2006.01)
*B65H 54/26* (2006.01)

(52) U.S. Cl. ..... 242/476.5; 242/473.7; 242/596.1; 242/596.7

(58) Field of Classification Search ..... 242/476.2, 242/476.1, 476.5, 476.6, 596.1, 596.7, 474.4, 242/475, 473.7; 57/281, 400
See application file for complete search history.

(56) References Cited

U.S. PATENT DOCUMENTS

| | | | | |
|---|---|---|---|---|
| 3,086,721 | A * | 4/1963 | Duff | 242/475 |
| 4,125,990 | A * | 11/1978 | Stahlecker et al. | 57/263 |
| 4,139,162 | A * | 2/1979 | Stahlecker | 242/473.6 |
| 4,178,748 | A * | 12/1979 | Stahlecker et al. | 57/263 |
| 4,539,803 | A * | 9/1985 | Ferro et al. | 57/263 |
| 5,711,142 | A | 1/1998 | Cromartie | |
| 5,875,626 | A | 3/1999 | Cromartie | |
| 6,398,152 | B1 * | 6/2002 | Burchert et al. | 242/474.7 |

FOREIGN PATENT DOCUMENTS

| | | |
|---|---|---|
| CH | 588 406 | 5/1997 |
| EP | 0 282 105 | 9/1988 |
| EP | 0 340 863 | 11/1989 |
| EP | 0 716 169 | 6/1996 |

OTHER PUBLICATIONS

EPO Search Report, Aug. 29, 2005.

* cited by examiner

*Primary Examiner*—Kathy Matecki
*Assistant Examiner*—William E. Dondero
(74) *Attorney, Agent, or Firm*—Hedman & Costigan

(57) ABSTRACT

Tailstock device to be applied to the cone-holding arm (26) of collection units (3) of spinning stations (1) of open-end spinning machines wherein the quill is engaged by a toothed tailstock provided with a skew pyramidal toothing on the face presented to the base of the quill.

6 Claims, 6 Drawing Sheets

28
25
27
26
3
20
21
b
16
22
29
15
F
11
a
14
12
F
2
9
9
8
5
6
7
S
4
1

Fig. 6A
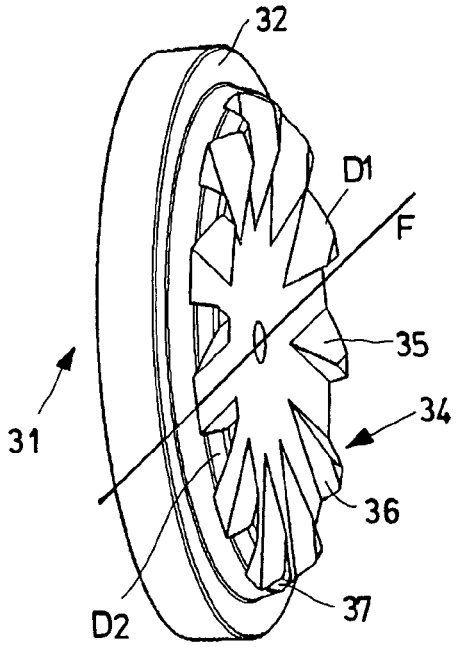
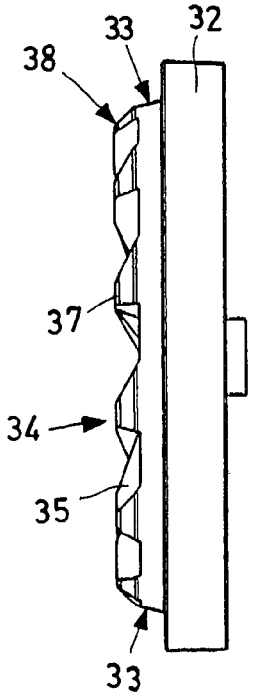
Fig. 6B
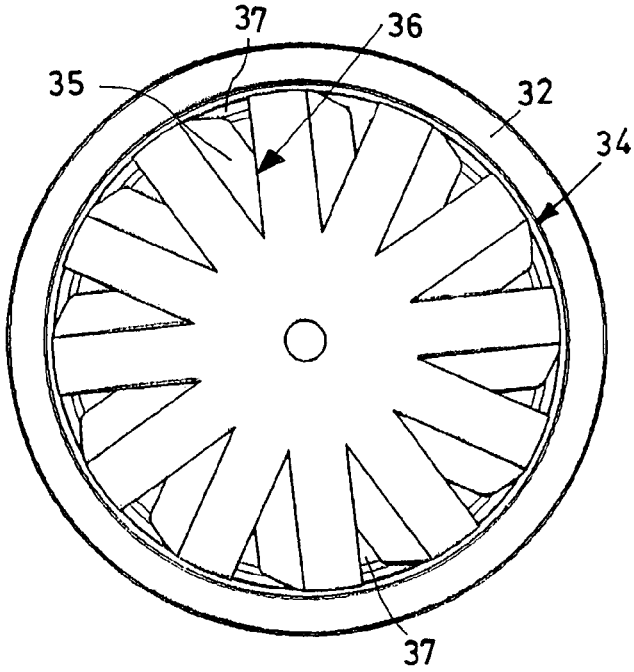
Fig. 6C

DEVICE AND PROCESS FOR DEPOSITING THE RESERVE OF THREAD ON THE QUILLS OF OPEN-END SPINNING MACHINES

The present invention refers to open end spinning, or rotor spinning. Open-end spinning machines generally consist of a plurality of individual spinning units, aligned on the two sides of the machine, each of which is made up of a spinning rotor, which produces twisted tread from singularised fibres of a rove, and a collection unit that—with the prior quality control of yarn with the interposition of a yarn clearer between the two components—carries the yarn to wind onto a quill to form a cone. This cone is thus formed pulling and winding the yarn on its surface, being pulled into rotation by the roller below on which the cone in formation is rested. The yarn is wound in a spiral on the cone in rotation since the collection unit is equipped with a thread-guiding device that distributes the yarn on the outer surface of the cone with to and fro axial motion.

The structure of the individual spinning station is illustrated in the scheme of FIG. 1, and its operation according to its normal running is briefly described hereafter.

Proceeding from the bottom towards the top, the single spinning station 1 consists of the actual spinning unit 2 and the collection unit 3, the main components of which that lead to the transformation of the rove of fibres made to run parallel in the cone of wound yarn are briefly illustrated hereafter.

The supply band or rove S is contained in a cylindrical vessel 4 where it is deposited in a double spiral. The rove S is supplied to the unit by a supply roller 5 passing through the funnel-shaped conveyor 6 and reaches the card 7, a rotating roller equipped with a toothed trimming that singularises the fibres of the rove S and conveys them by suction to the spinning rotor 8, which works in a vacuum.

In the spinning rotor 8, which rotates at very high speeds (up to 150,000 revs/minute and beyond), the singularised fibres are deposited in its peripheral throat by centrifugal effect; from here they are collected and picked up in the form of thread F, coming out axially from its central opening 9, receiving the twists from the rotation of the rotor itself in the path that runs between its inner throat and such an opening 9, thus generating the twisted thread F.

The pulling back of the thread is carried out with a pair of opposite extraction cylinders 11 and 12 for gripping the thread F and actuated at a controlled speed according to the arrow a, thus determining the linear production of yarn, generally indicated in m/min. The yarn clearer 14 for controlling the quality of the yarn F can be placed before the cylinders 11/12.

The thread F thus produced enters into the collection unit 3, passes by a sensor 15 of the presence of thread and meets a compensator 16 for compensating the variations in length of the path between the spinning unit 2 and the deposit point of the yarn F on the cone. The thread-guiding device 21 distributes the thread on the cone in formation moving transversally with to and fro motion according to the double arrow b, actuated by a motor 20 that commands a longitudinal shaft 22 in common with the other units of the spinning machine.

The cone 25 collects the thread F and is held by the cone-holding arm 26 equipped with two idle tailstocks 27 that can be opened that go into engagement with the basic quill 28 of the cone. For such a purpose the cone-holding arm 26 consists of a pair of prongs 26' that can be moved apart in the axial direction to separate the two tailstocks 27 and insert the new quill 28, or else discharge the finished cone 25.

The cone in formation 25 is rested upon its actuation roller or collection cylinder 29.

Recently conceived automatic open-end spinning machines are equipped with service trolleys that patrol the sides of the spinning machine and carry out the required interventions stopping in front of the spinning unit that requires it.

The required interventions are essentially of three types:

for starting, at the beginning of the spinning from a still spinning machine, starting it and then placing a new quill in each station, carrying out the start-up with an auxiliary thread and winding the thread produced on the new quill to give a cone, after having eliminated that portion of auxiliary thread;

for reattachment, when the yarn is interrupted for whatever reason, without having yet reached the length foreseen for completing the cone, using the yarn already produced by the side of the cone, carrying out the reattachment and continuing the winding on the same cone. The reattachment procedure essentially consists of the opening, cleaning and closing of the rotor, the preparation of the tail of the rove, the capturing and preparation of the end at the side of the cone, the restarting of the rotor and the continuation of the supply, the re-introduction of the prepared end into the rotor, the re-extraction of the end connected to the newly produced thread winding it once again in the collection unit. The programmed cleaning cycle is the equivalent to the reattachment cycle, caused with a commanded breaking of the thread;

for lifting, after having reached the foreseen length for the cone to be complete. The finished cone is discharged and then one proceeds to starting the unit as outlined above.

Generally, such interventions are carried out by separating the cone 25 from its actuation cylinder 29, stopping its motion and actuating the cone 25 or its quill 28 by an auxiliary actuation roller arranged on-board the service trolley.

In the field of devices and procedures for the intervention of service trolleys on automated open end spinning machines the applicant is the owner, amongst others, of patents IT 1.146.694, EP 340.863, EP 443.220, EP 473.212, IT 1.258.220, IT 1.258.221, IT 1.258.222.

In general, the automation trolley consists of a structure mobile along the sides of the machine, a communication system with the central control unit of the spinning machine and with the spinning unit that make up the machine, a translation and stopping system of the trolley in front of the units that require intervention. The mobile structure carries on-board both its control unit and the members or groups of members dedicated to the single or multiple operations of the various cycles, which can at various times be required and which can be managed by said control unit. The present invention is relative to a device for the insertion of the new quill between the two tailstocks of the cone-holding arm and for the initial winding of a length of thread at the base of the quill itself to constitute the initial reserve of a very compact cord of thread in the starting and lifting cycles carried out by the service trolley of the open-end spinning machine.

The purpose of the present invention is that of making a device for engaging the quill between the tailstocks that gives an effective deposit and firm attachment of the initial reserve of thread on the empty quill, before restarting the normal winding for the production of the new cone on the replaced quill.

Indeed, it should be taken into account that in the transitory steps, like in that of the start of winding on the new quill, there are significant differences in speed between the members involved, from which derive different tensions. For example, the speed of removal from the actual spinning unit 2 carried out by the cylinders 11, 12 quickly reaches the operating speed, whereas the collection unit has a slower acceleration ramp. Added to this there is also the pulsation caused by the thread-guide that, with its forward and backward motion, periodically lengthens and shortens the path of the thread increasing and decreasing both its collection speed and its tension.

Such a reserve has different functions during the course of the subsequent treatments of the yarn. Amongst these a rather important one is that of allowing the prior connection of the end of a cone, or rather of the coils of the reserve, with the start of the next cone, unwinding them during their use to produce fabric on a frame or on circular knitting machines.

The tension with which the initial thread is wound on the new quill to form the reserve on one of its ends is important. Such a tension gives the spirals of thread a cohesion and a compactness of the cord that makes it more difficult for it to slacken and unwind spontaneously.

For this purpose the reserve is deposited with a small traversing movement so that the coils are not parallel but slightly crossed and overlapping. However, there remains the problem deriving from the fact that the deposit of the reserve must take place with the thread already in formation that is sucked up by a mouth and eliminated: it must be cut and winding must begin instantly without the thread slackening.

An insufficient, or even just variable, tension generally produces an unstable reserve cord, which tends to slacken and drop coils or portions of thread from the cones during transportation or their arrangement in crates or chests. These slack threads of cones or of packages in general cause knots or become entangled in the parts with which they come into contact, making both transportation and automatic distribution of the cones, and the unwinding and use of the deteriorated, or even missing, reserve of thread very difficult.

According to patent EP 340.863, to the same applicant, the tautening of the thread is carried out by gripping it on the distributor pad of the reserve, operating with the new quill already placed in rotation at the operating speed resting it on its actuation cylinder 29. This way of proceeding to the depositing of the reserve and to the closing of the cone-holding arm already at full speed involves risks of uncontrolled sideways movements of the quill in this transitory step, especially if one is operating with frusto-conical quills.

The present invention refers to a device for firmly attaching the quill and for depositing the reserve of initial thread on the quill operating at a partial speed and with greater control of the quill and of the thread, which overcomes the drawbacks of devices available in the state of the art and allows a compact reserve of thread to be deposited on the quill with greater constancy and reliability.

To better highlight the problems tackled and the technical solutions proposed with the present invention we thus refer, in the following description, to a scheme of a trolley in which the device according to the invention is inserted, for servicing an open-end spinning machine, as a non-limiting example, with the explicit warning that it can advantageously also be used in a trolley in which the groups and the service members are different in type and arrangement.

Figure 3:
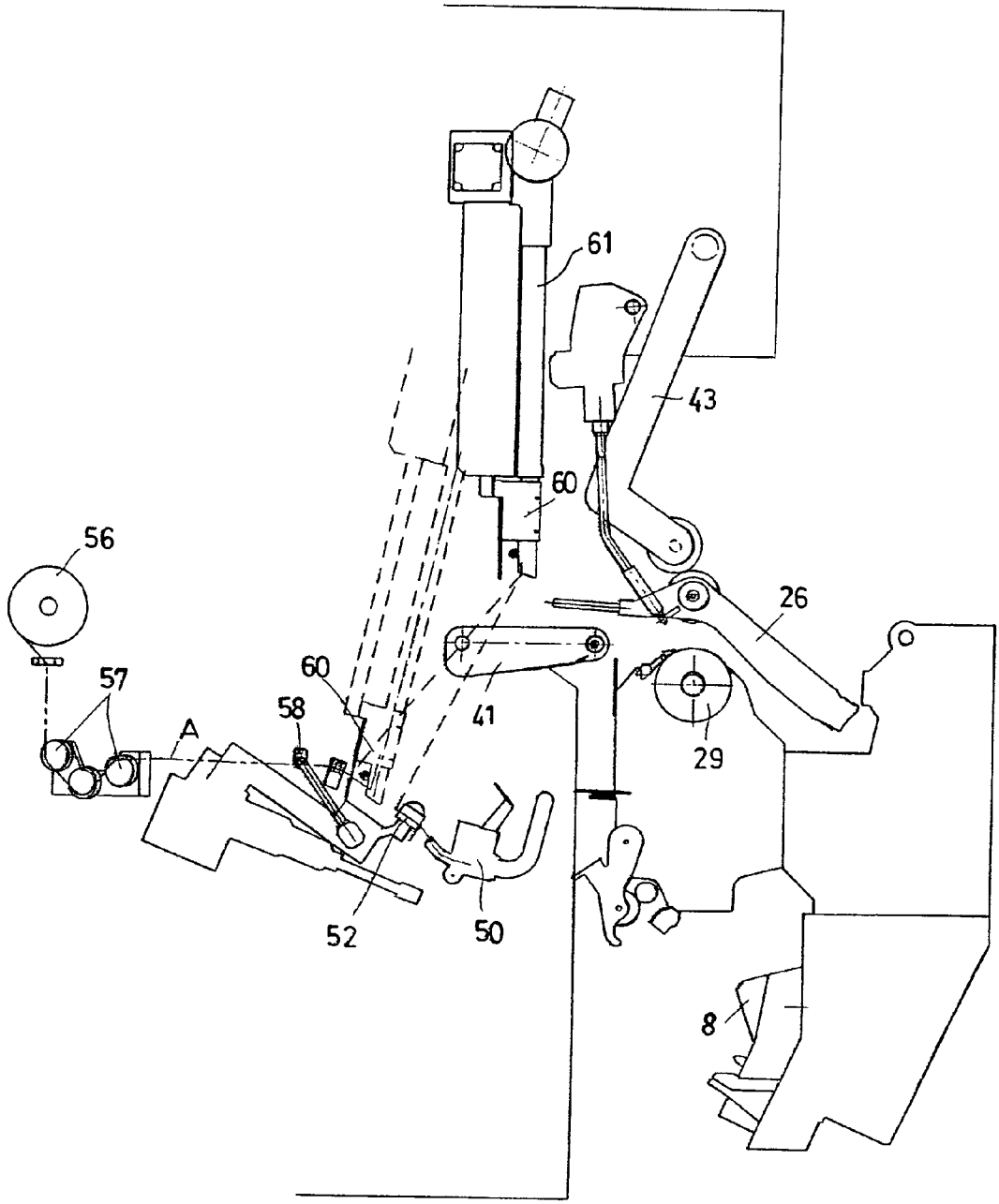
Figure 4:
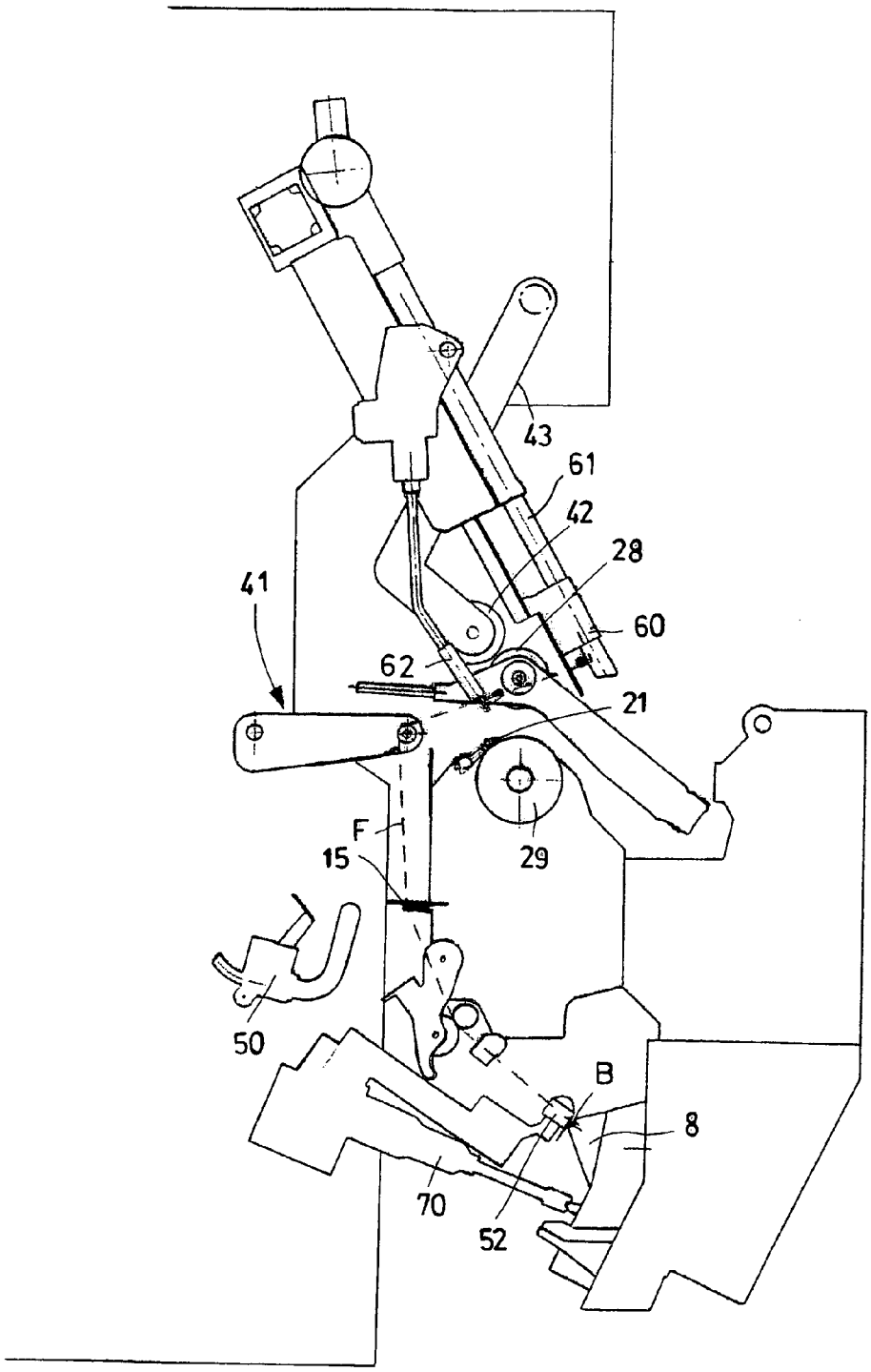

FIGS. 3 and 4 show the relative positions of the members of the trolley C described up to now, according to a side view of the members of the trolley facing the spinning unit seen in profile, and illustrate some of the configurations and functions that the device according to the invention takes up and performs during the lifting cycle carried out by an automation trolley for open-end spinning machines.

Figure 5:
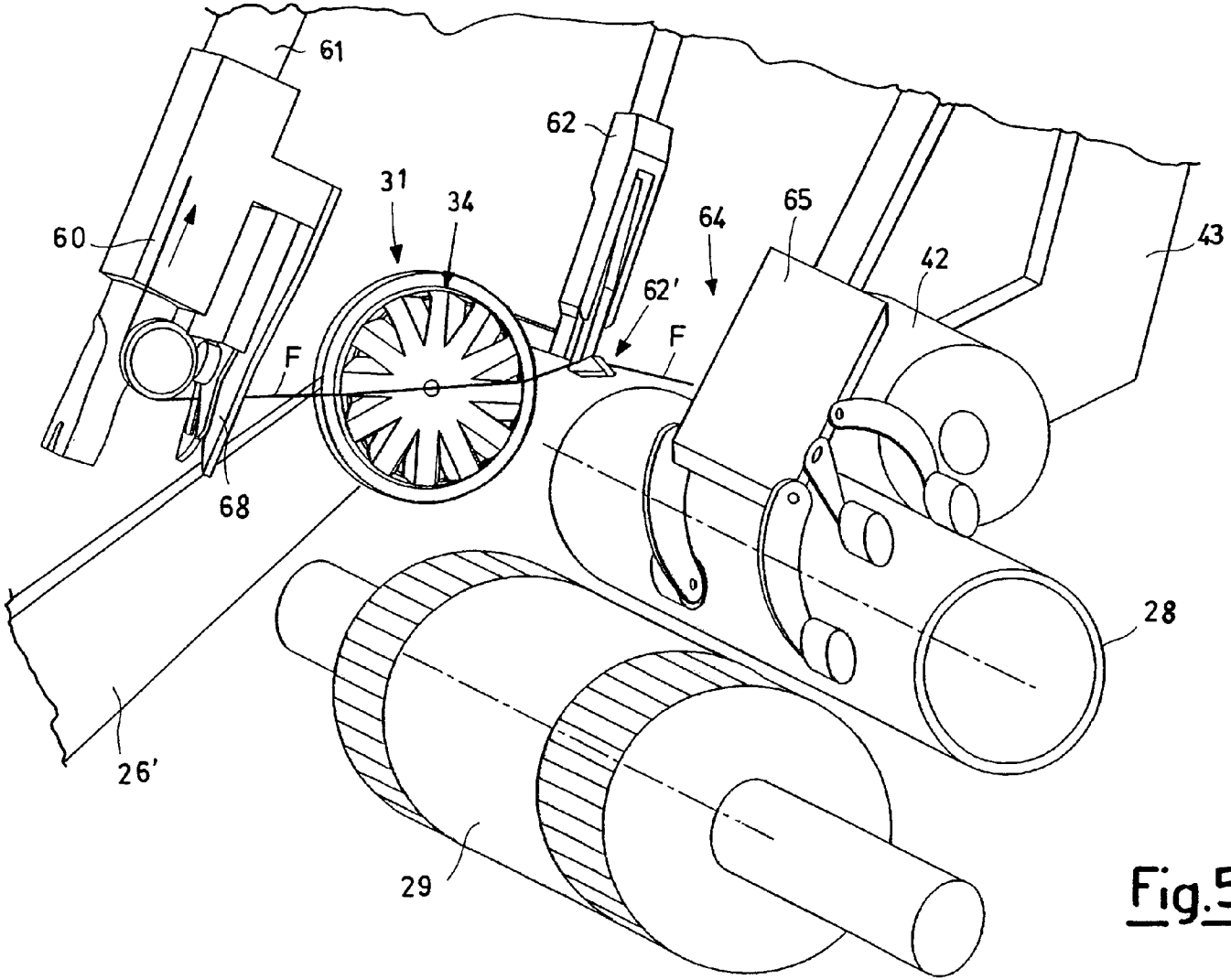

FIGS. 5 and 6 illustrate the structure of the device according to the invention, its actuation and its movement during the steps of the depositing of the reserve of thread on the new quill.

The device according to the invention is defined, in its essential components, in the first claim whereas its variants and preferred embodiments are specified and defined in the dependent claims.

Figure 1:
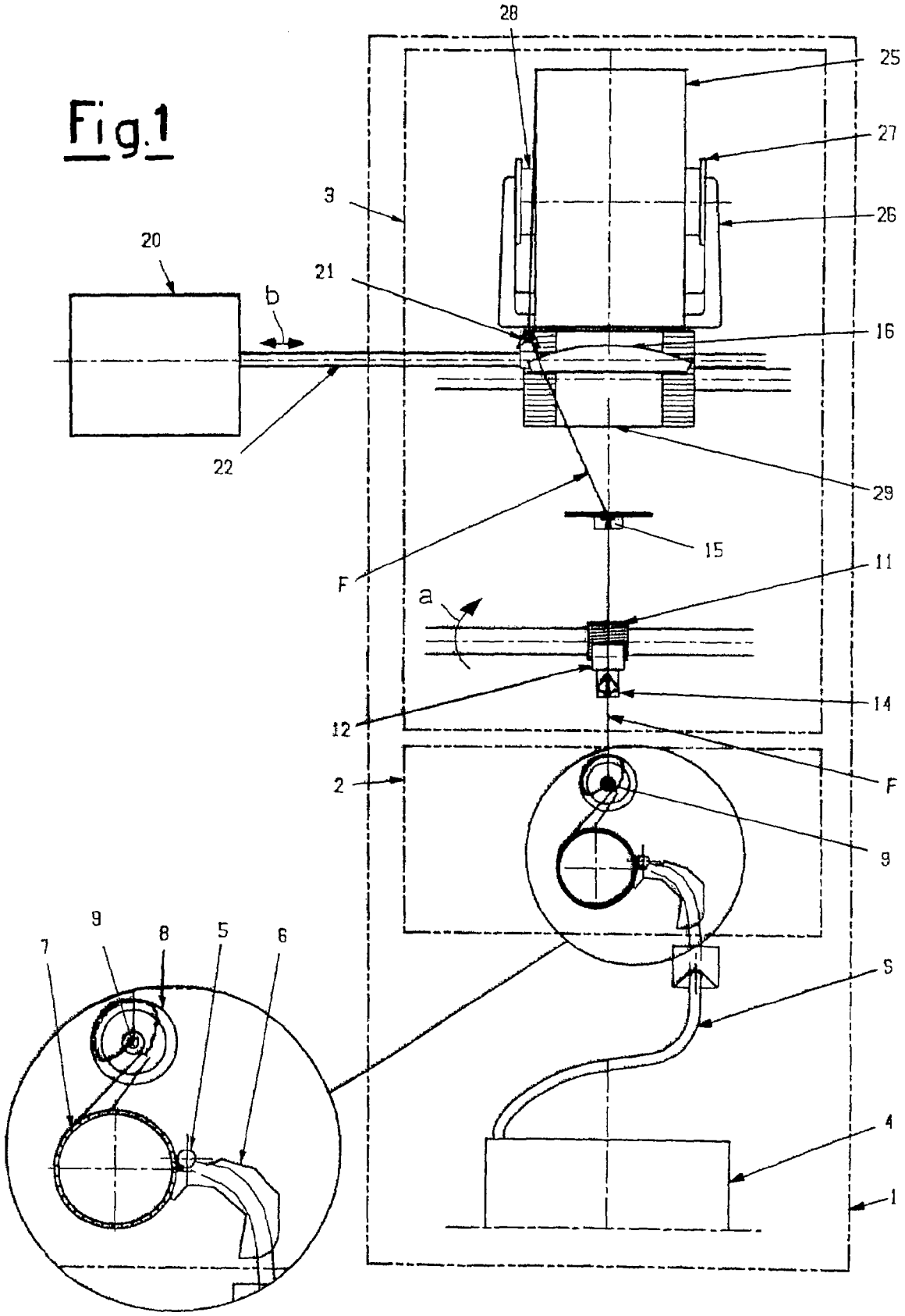
FIG. 1 illustrates the scheme of an open-end spinning station in its most significant components.
Figure 2:
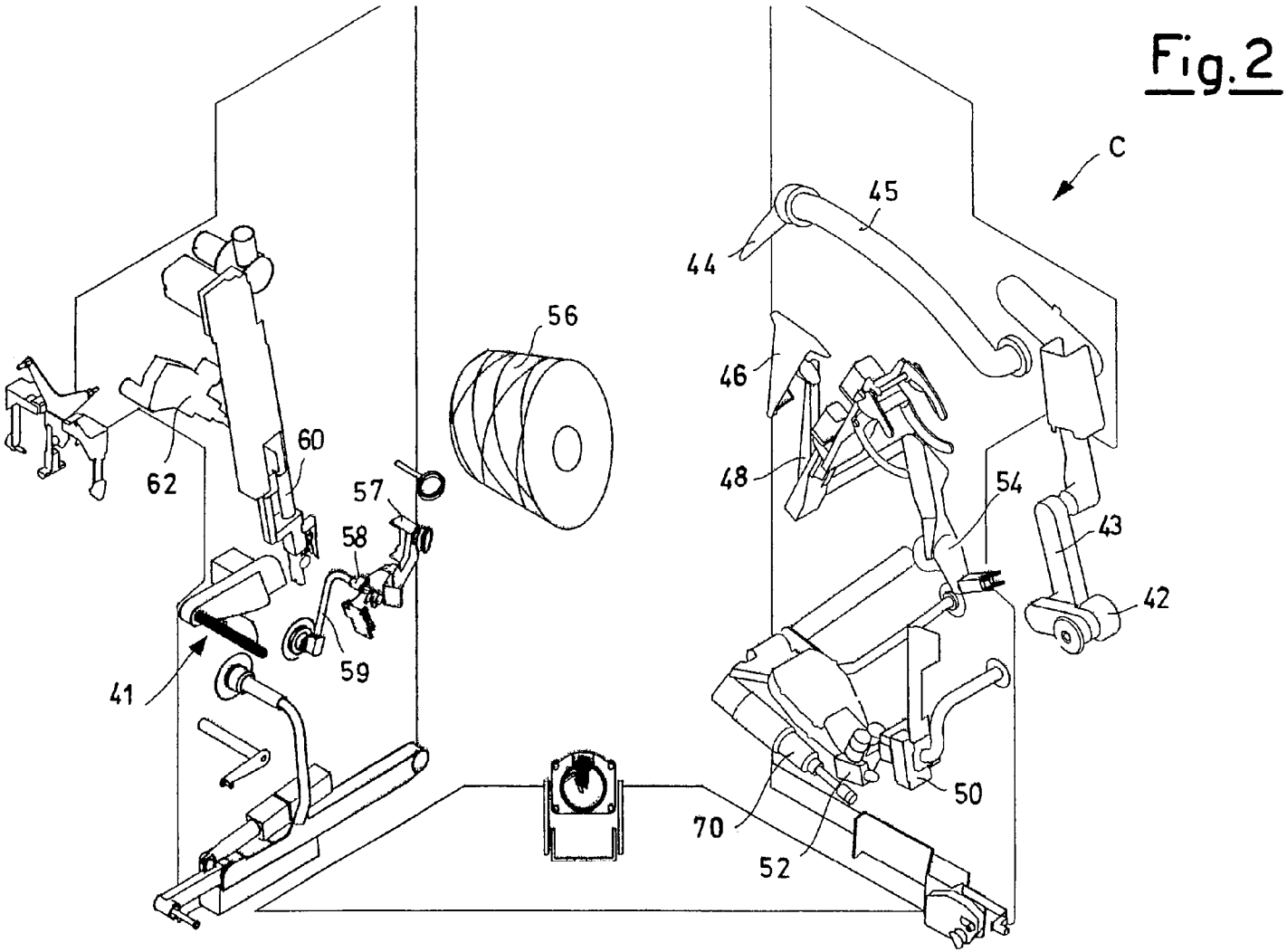
FIG. 2 illustrates a scheme of a service trolley C for an open-end spinning machines, in which the most significant members or groups that intervene in servicing as well as the device according to the invention for controlling and positioning the thread are indicated.

FIG. 2 shows an exploded view of the parallelepiped space inside the trolley C, in which its most significant members or groups for servicing the open-end spinning unit for controlling and positioning the thread and, in particular, for the reattachment operations are schematically indicated:

a device 41 for controlling and positioning the thread F during the intervention cycles that is used, during the intervention cycles, to determine the position of the thread connected with the cone or with its quill with respect to other members of the trolley;

an auxiliary actuation roller 42 of the cone 25 or of the new quill 28, according to a clockwise/anti-clockwise rotation, during the service interventions. It can be moved forwards/backwards so as to be closer/further away with rotation of its arm 43 about a horizontal axis parallel to the front of the spinning machine. The rotation of the arm 43 is also used to discharge the finished cone pushing it towards the middle plane between the sides of the spinning machine;

a mobile suction mouth 44 for capturing the end of the thread on the side of the cone 25. It can be moved forwards/backwards so as to be closer/further away with rotation of its arm 45 about a horizontal axis parallel to the front of the spinning machine;

a centraliser device 46, consisting of an engagement and displacement fork of the thread captured by the mouth 44. It is equipped with a sensor of the presence of thread inside of it and can be raised/lowered with rotation of its arm 48 about a horizontal axis parallel to the front of the spinning machine to serve the subsequent preparing group. More details on its structure and operation are described in patent EP 473.212.

a group 50 for preparing the end of the thread, mounted in a fixed position, which receives the thread from the centraliser 46, takes it, cuts it to size and prepares it for its re-introduction into the opening 9 of the spinning rotor 8. More details on its structure and operation are described in patent EP 443.220;

an introducing group 52 for gripping the end of the thread F prepared by the preparing group 50 and for supplying it to the spinning rotor 8 for the spinning to start up again. The introducing group also works in the lifting cycle operating on the auxiliary thread. It moves according to a trajectory from the preparing group 50 to the opening 9 to present the end of the thread to the rotor 8, which in rotation exerts a substantial sucking action;

a group 54 for lifting and opening the cone-holding arm 26, which disengages the cone from its roller 29 at the start and releases it at the end of each intervention cycle. The actuation open and closed of the tailstocks allows—in lifting operations—the discharge of the finished cone and the insertion of a new quill 28, gripping the thread F between its base and a tailstock.

As well as these groups, for the lifting and starting operations the following are foreseen:

a cone 56 of auxiliary thread A that is used to start spinning, in start-up or in lifting, with the tautening transmission 57 and the pincer 58 that has the auxiliary thread A. The pincer 58 is able to intersect both the trajectory followed by the introducing group 52 and that of the following gripping member 60, which can therefore take and control the auxiliary thread, take it to the preparer 50 and then go to introduce it to the spinning rotor 8 to carry out a reattachment of the auxiliary thread to the new thread in production. For such a purpose the pincer 58 is mounted on a motorised arm 59 that rotates in the plane of the figure and carries the auxiliary thread to be gripped by said manipulation members. Downstream of the pincer 58 there are scissors that, when the auxiliary thread A has been presented and gripped by such members, cut the thread leaving its end upstream still in the pincer 58, ready for it to be subsequently taken.

a hooked gripping member 60 with suction mouth for capturing and centering both the auxiliary thread and the initial new thread, to present it both to the reattachment members of the auxiliary thread during the lifting cycle and to grip the new thread between quill 28 and tailstock. Such a hook with mouth 60 is equipped with a V-shaped centerer and is mounted on an arm 61 that can be extended and rotated about a horizontal axis parallel to the front of the spinning machine.

a device 62 for depositing the initial reserve of thread at the end of the new quill 28, comprising the distributor pad with traversing already described in patent EP 340.863.

a quill-holding group 64, which carries the new quill 28 picking it up from a conveyor belt arranged above the side of the machine and presenting it to the tailstocks of the cone-holding arm 26, opened by the cone-lifting group 54. Such a quill-holding group comprises a sort of pincer 65 or set formed from many opposite horizontal rollers that holds the quill but allows it to rotate about its axis rolling between the rollers. The pincer is opened and closed to take and release the quill. The quill-holding group 64 can be moved towards/away from the gripping position of the quill 28 from the conveyor belt to the delivery position between the tailstocks.

On the cone-holding arm 26 of the open-end spinning station, one of the two prongs 26', and in particular the one at the side of the base of the quill 28 on which the reserve must be deposited, the device 31 for firmly attaching the quill and for depositing the reserve of initial thread on the quill according to the present invention is arranged, which is described in greater detail in the following FIGS. 5 and 6.

The members of the trolley are managed by the trolley's own control unit, which in turn communicates with the central control unit of the spinning machine and with the individual spinning stations. The trolley control unit coordinates the steps of the intervention cycles, imparts the actuation commands to its members and receives the detection thereof from the relative sensors and end stop, checking the positive outcome or not of each step taking the measures to suit the case.

To illustrate the operation and the characteristics of the device 31 for firmly attaching the quill and for depositing the reserve of initial thread on the quill the lifting cycle is described in its significant steps with reference to FIGS. 3 and 4, which show the positions taken up by the members of the trolley involved in lifting.

In general, once the limit length foreseen for the cone 25 has been reached the spinning is stopping giving off a signal. As for the reattachment cycle, the peripheral control unit of the unit takes care of lifting the cone 25 disengaging it from its cylinder 29, braking the cone itself and requesting the intervention of the service trolley. When the service trolley C had arrived in position in front of the spinning unit to be serviced, its raising group 54 further lifts the cone 25, leaving it idle; the arm 43 is then rotated up to its maximum extension to take the auxiliary actuation roller 42 against the finished cone 25, to discharge it with a push towards the middle between the fronts of the spinning machines where a conveyor belt device, already known in the prior art, periodically evacuates the finished cones that have been pushed into the middle between the two sides of the machine. For the sake of simplicity of drawing, such parts are not shown in FIGS. 3 and 4.

As already stated, the raising group 54 also operates the opening and closing of the tailstocks 31 of the arm 26 for the discharge of the finished cone and the insertion of a new quill 28. The quill-holding group 64 and its gripping and presentation member 65 of the new quill that will have to constitute the support on which the new cone 25 shall form is also brought closer.

The introducing group 52 withdraws to take and grip the auxiliary thread A between its members and advances into the position shown in FIG. 3, with a length of the end B before it. The thread A is taken between the introducing group 52, the pincers 58 and continues towards the cone of auxiliary thread 56. The member 60 for gripping the thread lowers down (position with a broken line) and takes the thread from the pincer 58, raises up and turns in the anti-clockwise direction into the position shown in FIG. 3 (position with a full line) taking a length of thread away from the cone 56. The thread A is then cut from the side of the pincers 58 and takes up the end configuration of FIG. 4. The device 41 is raised into the work position. From the introducer 52 the end B is introduced, cut to size and prepared in the preparer 50.

As shown in FIG. 4, one proceeds to reattachment with the auxiliary thread A: the introducer 52 introduces the end B into the opening 9 of the rotor 8, to pick up, with such an end, the new thread formed with the fibres of the rove S once again supplied to the spinning unit 2, to deposit a dosed amount of fibres for reattachment. The actuation of the supply in the reattachment step is carried out with a telescopic rotating shaft 70 that is extended to engage and actuate the supply roller 5 of the rove for the necessary time. Such a member is installed in the same introducing group 52 of the end of the thread.

The newly produced thread is sucked with the mouth of the member 60 and is introduced into the thread sensor 15. With such suction the portion of auxiliary thread used for reattachment is sucked up and eliminated. The gripping member 60 is advanced further towards the spinning unit inserting—in cooperation with the device 41—the new thread between the base of the quill 28 and its tailstock 31 that is still open.

The engagement step of the newly produced thread with the new quill 28 is described with reference to FIGS. 5 and 6.

As shown in FIG. 5, the thread F is taken between the base of the new quill 28 and the open tailstock 31. In the configuration of FIG. 5 the following are shown in perspective:

the thread F coming from the spinning unit that passes onto the device 62 for depositing the reserve and continues to flow and be sucked up by the mouth of the member 60, passing between the open tailstock 31 and the base of the new quill 28;

the device 62 for depositing the reserve that comprises an oscillating pad 62' that, during the depositing of the reserve thread, carries out the oscillation that gives the traversing in crossing and overlapping coils;

the quill-holder 64 with its set or pincer with rollers 65 that carries the quill 28 between the open tailstocks, which is placed into rotation with the auxiliary roller 42;

the device 31 for firmly attaching the thread of the reserve according to the invention is arranged on the prongs 26' of the cone-holding arm 26 at the side on which the reserve of thread must be deposited, to constitute a toothed tailstock 31. Its structure is shown in greater detail in FIGS. 6A, B, C. FIG. 6A shows a perspective view thereof, FIG. 6B shows a cut view and FIG. 6C shows a front view.

The base of the toothed tailstock 31 consists of a disc 32 and a slightly conical neck 33, coaxial with the disc 32, and with a diameter such as to receive and hold in position the inside of the quill 28. The peripheral crown of the disc 32 constitutes the seat for the quill between the two tailstocks.

On the flat outer face of the neck 33—and preferably on its periphery—a skew pyramidal toothing is made formed from teeth 34, having a face 35 inclined with respect to the face of the neck itself and the opposite face 36 substantially perpendicular to it. On the outside of the teeth 34 a chamfer 38 for receiving and centering the quill is made.

As shown in FIG. 6A, by placing a thread F against the device 31 in contact with the opposite teeth D1 and D2, the clockwise rotation of the device 31 would engage the thread with their steep faces 36 and would pull it into rotation. Its anti-clockwise rotation, on the other hand, would present their inclined faces 35 to the thread F, and would allow them to be passed over the top 37 by the thread F, which would not be put into rotation.

The skew pyramidal toothing is applied with a number of teeth 34 preferably between 8 and 20. The inclination of the inclined wall 35 of the teeth 34 is from 20° to 50° with respect to the plane from which they project.

The toothed tailstock 31 for the cone-holding arm performs the double task of tautening the thread during the formation of the reserve and of eliminating the risks deriving from sideways movements of the quill on the set 65. Indeed, the device allows the closing of the tailstocks and the starting of rotation of the quill to be carried out simultaneously.

The procedure is carried out as follows.

At the start, the thread F continues to be produced and to flow in the mouth of the device 60, the cone-holding arm 26 is completely open, the new quill 28 is immobile, presented between the open tailstocks and lifted by the cylinder 29. The mouth 60 moves to place the thread F between the base of the quill 28 and the toothed tailstock 31, continuing to suck it. The device 62 engages the thread F in the configuration of FIG. 5.

From such a configuration, in quick succession the quill 28 is placed in rotation with the roller 42, the cone-holding arm 26 is closed, the thread F is cut by the scissors 68 of the mouth 60 and the oscillating pad 62' is actuated, which carries out the traversing to form the reserve of thread.

In this step the thread F is firstly trapped between two opposite teeth, for example D1 and D2, and is then gripped between tailstock 31 and quill 28, then pulled into rotation by the teeth of the tailstock 31. Their shape, as shown in FIG. 6, does not allow the thread F to pass over them in one direction, as occurs when the tailstock 31 is immobile and detached whilst the quill 28 is already in rotation, but does allow it in the opposite direction, as occurs during the acceleration of the tailstock itself 31 that starts from stationary whilst the quill 28 is already in rotation.

The skew toothing with the teeth 34, in the brief time period of the closing step in which the quill that is already rotating presses the thread against the seat 32 of the tailstock that is still stationary, ensures that the thread F, which is the first to come into contact with the edge of the rotating quill, in any case remains held in diametric position by the steep wall 36 of the teeth 34 that are still stationary, until the closing of the cone-holding arm 26 and of the tailstock pulled into rotation by the quill.

For this purpose it should be noted that the outer edge 38 of the chamfered teeth allows the thread F not to be gripped but only trapped—i.e. held in diametric position—until the base of the quill 28, in the closing of the arm 26, rests upon its seat 32.

The toothed tailstock device 31 carries out the certain pulling into rotation of the thread without the possibility of losing it, as, however, can occur with a conventional tailstock, without toothing.

For considerations of geometry and tolerances, the thread may not be gripped simultaneously in the two opposite points at the inner circumference of the base of the quill and outer circumference of the seat of the tailstock: the rotation of the quill 28 tends to carry the portion of thread outside of the grip of the stationary tailstock before it closes tight, thus not allowing it to be gripped.

Having carried out the connection of the reserve of thread to the end of the new quill 28 and having re-established the normal path of the thread from rotor 8 to cone 25, the normal winding of the new thread F, which is freed, restarts. The quill 28 of the new cone in formation is lowered on its cylinder 29, whereas the thread is hooked by the thread guide 21 at the first useful passage. The trolley has completed its task, can withdraw its members to rest and be directed towards other units of the spinning machine.

The toothed tailstock device 31 according to the invention is able to carry out the tautening and control of the thread during the formation of the reserve, keeping the quill in correct position during such an operation. The device allows—within an automatic service trolley for open-end spinning machines—the closing of the tailstocks and the starting in rotation of the quills to be carried out simultaneously. The toothed tailstock device has substantial progressions with respect to devices of the prior art. The possibility of carrying out the operation of starting winding and of depositing the reserve of thread at a partial and controlled speed is very important.

The reserve of thread is deposited with greater reliability and constancy of quality as regards its compactness and hold on the quill.

The invention claimed is:

1. Tail stock device to be applied to a cone-holding arm (26) of collection units (3) of spinning stations (1) of open-end spinning machines comprising of a disc (32) and a neck (33) of a diameter such as to receive and hold in position the inside of a quill (28), the peripheral crown of the disc (32) constituting the seat for the quill between two tailstocks, characterized in that at least one of the tailstocks (31) is a toothed tailstock provided with a skew pyramidal toothing formed from teeth (34) on the outer face of the neck (33), the teeth (34) having a face (35) inclined with respect to the face of the neck itself and said face being substantially perpendicular to an opposite face (36).

2. Tailstock device according to claim 1, characterized in that said skew pyramidal toothing formed from teeth (34) is made on the periphery of the outer face of the neck (33).

3. Tailstock device according to claim 1, characterized in that said skew pyramidal toothing is applied with a number of teeth (34) between 8 and 20.

4. Tailstock device according to claim 1, characterized in that skew pyramidal toothing is formed from teeth (34) having an inclination with respect to face (35) of between 20° and 50° with respect to the plane of the outer face of the neck (33) from which they project.

5. Process for stating the collection and depositing of the reserve of thread on the new quill (28) in the collection units (3) of the spinning stations (1) of open-end spinning machines during the lifting cycles carried out through automatic service trolleys characterized in that it comprises the following step in sequence:

interposition of the thread (F) between the base of the quill (28) and a toothed tailstock (31), starting in rotation of the new quill (28) with a auxiliary roller (42) of the trolley, closing of the cone-holding arm (26) at the ends of the quill (28), cutting of the thread (F) and depositing of the reserved of thread with the oscillating pad (62'), which carries out traversing to form the reserve of thread, in this step the thread (F) being kept in position engaged by skew pyramidal toothing of a toothed tailstock (31) arranged on the cone-holding arm (26).

6. Process for starting the collection and depositing of the reserve of thread on the new quill according to claim 5, characterized in that the depositing of the reserve of thread is carried out at a reduced speed.

* * * * *